United States Patent [19]

Yamamura et al.

[11] Patent Number: 4,975,025

[45] Date of Patent: Dec. 4, 1990

[54] HYDRAULIC RADIAL PISTON PUMP

[75] Inventors: Makoto Yamamura, Sagamihara; Fumiaki Katagawa, Kani, both of Japan

[73] Assignee: Kayaba Kogyo Kabushiki Kaisha, Tokyo, Japan

[21] Appl. No.: 369,988

[22] Filed: Jun. 22, 1989

[30] Foreign Application Priority Data

Jul. 1, 1988 [JP] Japan ..... 63-164355

[51] Int. Cl.[5] ..... F04B 1/04

[52] U.S. Cl. ..... 417/273; 92/61

[58] Field of Search ..... 417/273; 92/61

[56] References Cited

U.S. PATENT DOCUMENTS 3,744,380 7/1973 Steiger ..... 417/273

4,673,337. 6/1987 Miller ..... 417/273

*Primary Examiner*—A. Michael Chambers

*Attorney, Agent, or Firm*—Jordan and Hamburg

[57] ABSTRACT

A hydraulic radial piston pump having a plurality of pistons arranged radially around the rotary shaft for sequential reciprocating motion in which working oil is introduced from the inner oil chamber in the pump casing supporting the rotary shaft and pistons passed into the outer oil chambers provided behind the pistons and then, discharged from these outer oil chambers to delivery passages. A eccentric motion element, the outer periphery of which abuts on the head of each piston, is connected to the rotary shaft by connecting means so that the eccentric motion element can perform eccentric movements about the rotary shaft. The eccentric motion element is also prevented by rotation stopper means from rotating about the rotary shaft. The piston has a suction orifice provided in the head thereof which is yieldingly pressed against the outer periphery of the eccentric motion element by spring means. The outer periphery of the eccentric motion element is equipped with grooves for the opening and closing of the suction orifices to the inner oil chamber in accordance with the relative circumferential motion of the eccentric motion element with respect to the piston. Accordingly, while the groove allows the suction orifice to open or close to the inner oil chamber in relation to the stroke motion of the piston, the full length of the stroke in the extended position and in the retracted position of the piston can be designated as a suction stroke and a discharge stroke respectively.

4 Claims, 3 Drawing Sheets

HYDRAULIC RADIAL PISTON PUMP

BACKGROUND OF THE INVENTION AND RELATED ART STATEMENT

The present invention relates to a hydraulic radial piston pump having a set of pistons arranged radially around the rotary shaft for sequential reciprocating motion for suction and delivery of working oil.

A prior-art, hydraulic radial piston pump is arranged, for example, as shown in FIG. 6, in which an eccentric cam 3 is rigidly mounted onto the rotary shaft 2 and installed within the inner oil chamber 4 formed in the pump casing 1. Each one of the radially arranged cylinders 1A provided in the pump casing 1 accommodates a piston 6 which can slide therein and is actuated by the eccentric cam 3. The inner oil chamber 4 communicates with a reservoir, not shown, and hence, is kept filled with working oil.

The head of the piston 6 extends inwardly into the inner oil chamber 4. The outward end of the cylinder 1A is closed with a cap 7 fitted into the pump casing 1. There is provided an outer oil chamber between the cap 7 and the back of the piston 6. The head of the piston 6 is pressed against the periphery of the eccentric cam 3 by a spring 8 interposed between the cap 7 and the back of the piston 6.

A suction orifice 21 is made at the head end side of the piston 6 for communication with the inner chamber 4. The suction orifice 21 opens when the piston 6 loaded by the spring 8 advances into the inner oil chamber 4 following the movement of the cam 3 and closes when the piston 6 retracts into the pump casing 1 through the outward stroke movement.

The piston 6 is thus displaced by the rotary motion of the cam 3 as shown in FIG. 7. More specifically, the piston 6 first slides from the maximum compression position (top dead center) inwardly so as to enlarge the outer oil chamber 5 and open the suction orifice 21 for introduction of working oil from the inner oil chamber 4 into the outer oil chamber 5 and secondly, after reversing its sliding motion at the maximum extended position (bottom dead center), retracts into the pump casing 1 with the suction orifice 21 being closed so as to pressurize the working oil in the outer oil chamber 5 and then, discharge it via a check valve through a delivery passage not shown. The piston 6 repeats this cycle at periodic intervals corresponding to the rotational angle of the eccentric cam 3. Accordingly, the working oil is sequentially discharged from the outer oil chambers 5 to their respective delivery passages.

The prior-art, pump, however, has such a disadvantage that the noise and vibration during operation increase and thus, the durability decreases. This results from the cavitation generated due to a drop in the internal pressure of the outer oil chamber 5 during the extension of the outer oil chamber 5 without introduction of working oil shown in FIG. 7, the pulsation of delivery pressure created due to a short delivery period defined between 240 to 350 degrees, and the abrupt change of pressure caused at the start of delivery due to a faster sliding speed of the piston 6 approximately at the 240 degrees stage. Also, the effective length of stroke of the piston 6 is short and it is thus necessary to increase the eccentricity of the cam 3. Furthermore, as shown in FIG. 8, the head of the piston 6 comes into linear contact with the cam 3 and creates a considerably high rate of surface contact pressure. This causes their contact portions to wear quickly and simultaneously, produce more noise during the operation.

Another radial piston pump using a plurality of pistons arranged around an eccentric cam is disclosed in Japanese Patent Provisional Publication No. 47-12684, in which during the inward motion of a piston actuated by the rotary motion of the eccentric cam, working oil is introduced into the oil chamber provided behind the piston through a groove formed in the eccentric cam and a flow port formed in the head of the piston. This radial piston pump allows the eccentric cam to rotate at a relatively high speed with respect to the piston head and thus, causes either of them to wear quickly. It is also acknowledged that the problem of incidental noise is not yet solved. Because the difference of relative operating speed is great between the groove and the flow port, it is difficult to determine the timing for opening and closing motions.

U.S. Pat. No. 3,003,462 discloses a radial piston pump in which the reciprocating motion of a plurality of pistons arranged around an eccentric cam is actuated by the eccentric motion of a polygonal ring fitted onto the periphery of the eccentric cam. This radial piston pump includes a couple of one-directional valves for suction and delivery respectively so that working oil can be sucked in and discharged by the extension and reduction of an oil chamber provided behind each piston. Accordingly, its arrangement becomes elaborate and its pump casing becomes large in size. Additionally, the suction is controlled by the one-directional suction valve and its timing can hardly be determined arbitrarily.

The purpose of the present invention is thus to eliminate the disadvantages of the foregoing prior-art, radial piston pumps.

It is the primary object of the present invention to provide a radial piston pump which has a simpler arrangement, improved durability, reduced mechanical noise, and can be adapted for arbitrary setting of the suction timing.

SUMMARY OF THE INVENTION

A radial piston pump according to the present invention has a pump casing enclosing an inner oil chamber for receiving working oil from the outside and a set of radially arranged cylinders formed therein so as to communicate through one end with the inner oil chamber. The cylinder accommodates a piston having a suction orifice in its head and can slide therein for reciprocating motion. The pump body incorporates a rotary shaft supported therein. It rotates about the central axis and extends across the inner oil chamber. An eccentric motion element is provided having its periphery abutting on the pistons and joined to the rotary shaft by a connector for eccentric motion about the central axis. The connector consists of an eccentric cam of circular shape rigidly mounted onto the rotary shaft in combination with the eccentric motion element which has in turn an annular shape for relatively rotational motion with respect to the periphery of the eccentric cam, as will be described hereinafter in the form of an embodiment of the present invention. The eccentric motion element is provided with rotation stopper to prevent its rotation about the central axis. The rotation stopper is so arranged that the flat heads of their respective pistons are tightly kept abutting on plane portions of the outer periphery of the eccentric motion element provided according to the number of the pistons. Each piston has its head tightly pressed against the periphery of the element by a spring. The plane portion of the eccentric motion element has a groove provided therein in such a way that the groove remains open to the inner oil chamber and can be positioned opposite to the suction orifice of the piston when the piston advances inwardly in response to the movement of the eccentric motion element. Provided behind the piston is an outer oil chamber which in turn communicates with a delivery passage formed in the pump casing. A one-way valve is mounted in the middle of the delivery passage to allow the flow of working oil to pass only from the outer oil chamber. As the rotary shaft rotates, the eccentric motion element performs eccentric movements along a circular track having a radius equal to the distance of eccentricity. The periphery of the eccentric motion element then moves forward and backward circumferentially thereof along the flat head of the piston and simultaneously, actuates the piston which moves radially inward and outward around the rotary shaft. The stroke of the piston has a position relationship with the relative circumferential movement of the eccentric motion element with respect to the piston and thus, the groove in the periphery of the eccentric motion element permits the suction orifice in the piston to communicate with the inner oil chamber through the relative movement. Accordingly, the working oil in the inner oil chamber will be sucked outwardly through the suction orifice by the inward stroke of the piston in the direction of extension of the outer oil chamber. When the piston moves outward in the direction of reduction, its suction orifice closes and, at that time, the working oil in the outer oil chamber is discharged via the one way valve through the delivery passage.

DETAILED DESCRIPTION OF THE PREFERRED EMBODIMENTS

A preferred embodiment of the present invention is shown in FIGS. 1 through 4.

Figure 1:
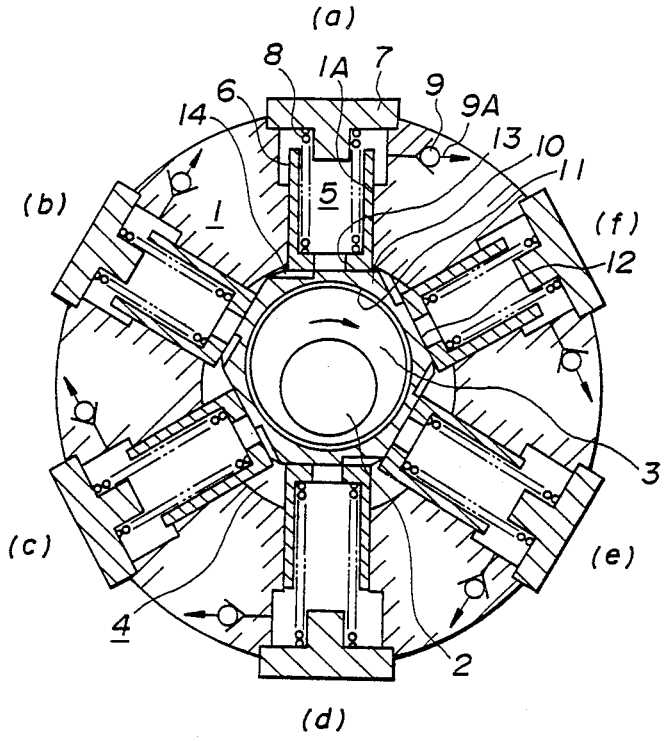
FIG. 1 is a cross sectional front view of one embodiment of a hydraulic radial piston pump according to the present invention.

As shown in FIG. 1, there are provided a pump casing 1, a rotary shaft 2, and an eccentric cam 3 of circular section mounted onto the rotary shaft 2 in eccentric arrangement. The rotary shaft 2 is supported by the pump casing 1 for rotation about the central axis which extends across an inner oil chamber formed in the pump casing 1. The eccentric cam 3 is accommodated within the inner oil chamber 4. Six cylinders 1A radially arranged around the rotary shaft 2 are provided in the pump casing in an outward arrangement from the inner oil chamber 4. The cylinder 1A accommodates a sliding piston 6 so that the flat head of the piston 6 can radially extend into the inner oil chamber 4. The piston 6 has a suction orifice 13 formed in its head for opening to an outer oil chamber 5 provided behind the piston 6. The outer oil chamber 5 is situated between the back of the piston 6 and a cap 7 fitted into the pump casing 1 for closing the outer end of the cylinder 1A. A spring 8 is mounted between the piston 6 and the cap 7 for loading the piston 6 inwardly. The outer oil chamber 5 communicates with a delivery passage 9A equipped with a one-way valve 9 which allows the flow of working oil to pass from the outer oil chamber to the outside.

Figure 2:
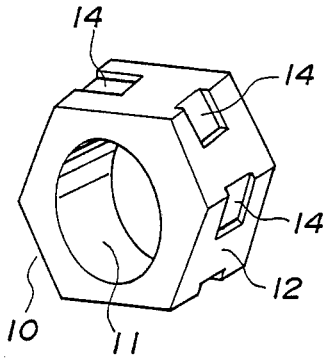
FIG. 2 is a perspective view showing an annular eccentric motion element of FIG. 1.
Figure 3:
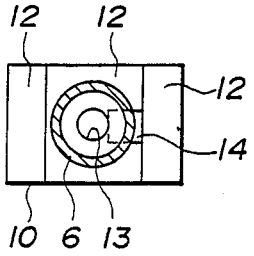
FIG. 3 is a plan view of the eccentric motion element showing the position relation between a suction orifice in the piston and a groove of FIG. 1.

An annular eccentric motion element 10 which has an inner circular periphery 11 with an inner diameter equal to the outer diameter of the eccentric cam 3 and also, an outer periphery 12 of hexagonal configuration correnponding to six of the pistons 6, fitted onto the eccentric cam 3 and can rotate freely. The head of the piston 6 is pressed against a plane portion of the outer periphery 12 of the eccentric motion element 10 by the compression of the spring 8. The plane portion of the outer periphery 12 of the eccentric motion element 10 presents a groove 14 formed therein as shown in FIG. 2. As shown in FIG. 3, the groove 14 is arranged in such a way that its axial width is smaller than outer diameter of the piston 6 so that the inner oil chamber 4 can be reached only through the periphery of the eccentric motion element 10. The groove 14 is moved to a position opposite to the suction orifice 13 in the piston 6 when the piston 6 advances inwardly during the stroke following the movement of the eccentric movement element 10. When the suction orifice 13 coincides with the groove 14, the outer oil chamber 5 communicates with the inner oil chamber 4.

When the rotary shaft 2 is driven, the eccentric cam 3 equipped with the rotary shaft 2 rotates. The eccentric motion element 10 fitted onto the eccentric cam 3 then performs an eccentric motion along a circular track having a radius equal to the distance of eccentricity of the cam 3 while being guided by the cam 3 rotating relatively on the inner periphery 11 of the eccentric motion element 10. The eccentric motion element 10 is prevented from rotating by keeping the plane portions of its periphery 12 in contact with the flat heads of their respective pistons 6 by the loading force of the spring 8 and thus, will not rotate together with the eccentric cam 3 but only goes through the eccentric motion.

When the eccentric cam 3 rotates through a full turn, the periphery 12 of the eccentric motion element 10 moves circumferentially through one cycle while each of its groove 14 is displaced relatively with respect to the suction orifice 13 in the head of the piston 6 while moving, radially through one cycle so as to actuate the piston 6. For example, when the piston 6 is at the top dead center and retracted to the furthermost end of the outer oil chamber 5 as represented by (a) of FIG. 1, the suction orifice 13 thereof remains uncommunicated with the groove 14. As the eccentric cam 3 rotates clockwisely through a further 60° angle, the plane portion of the element periphery 12 moves downward to the right of the piston 6 in the eccentric action. Then, the groove 14 of the periphery 12 coincides with the suction orifice 13 of the piston 6 and at the same time, the head of piston 6 extends into the inner oil chamber 4 following the displacement of the element periphery 12, as represented by (b) of FIG. 1. Subsequently, as the eccentric cam 3 rotates through a further 60° angle, in the same direction, the piston 6 reaches the position as denoted by (c) of FIG. 1. Finally, when the eccentric cam 3 rotates through another 60° angle, the piston 6 reaches the bottom dead center extending to the furthermost end of the inner oil chamber 4, as represented by (d) of FIG. 1. Throughout the steps of process from (a) to (d), the outer oil chamber 5 continues to expand and working oil will thus be transferred from the inner oil chamber 4 via the suction orifice 13 open through the groove 14 into the outer oil chamber 5. At the end of the step (d), the suction orifice 13 is again closed to the groove 14. The piston 6 reverses its sliding direction at the bottom dead center and then, starts retracting into the outer oil chamber 5. As the groove 14 moves away from the suction orifice 13, the outer oil chamber 5 becomes discontinued from the inner oil chamber 4. Simultaneously, in response to the rotation of the eccentric cam 3, the capacity of the outer oil chamber 5 gradually decreases as represented by (e) and (f) of FIG. 1., thus allowing the pressurized flow of working oil to open the check valve 9 and discharge through the delivery passage 9A. Accordingly, when the eccentric cam 3 rotates through 180° from the step (d), the piston 6 returns to the top dead center for setup of the step (a).

Figure 4:
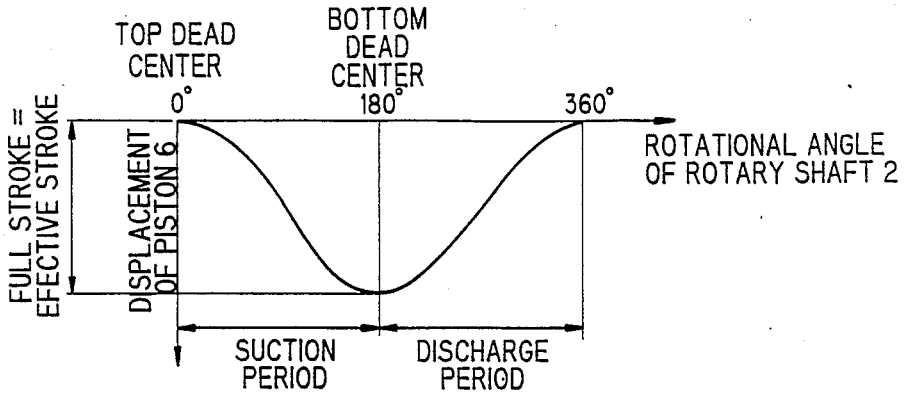
FIG. 4 is a timing chart showing the timing of suction of the hydraulic radial piston pump of the embodiment of the present invention with respect to the relation between rotational angle of the rotary shaft and stroke of the piston.

As for the continuous reciprocating motion of the piston 6 in response to the rotation of the eccentric cam 3, one cycle of the motion is divided into one suction and one discharge periods as shown in FIG. 4. This provides no stage during which the outer oil chamber 5 is expanded without any intake of working oil and thus, the generation of cavitation will be prevented in the outer oil chamber 5. The pistons 6 are operated at equal angular intervals of 60° during the steps of procedure represented by (a) to (f) for consistent discharge of working oil to the delivery passages. Because half of each step is designated as a discharge period, the pulsation of delivery pressure will be minimized. The shift from suction to discharge is executed according to the reversal period of the motion of the piston 6 when the sliding speed of the piston 6 is zero, thus imparting a moderate change in the pressure inside the outer oil chamber 5. The piston 6 travels throughout the entire length of the stroke. It is thus not necessary to increase the displacement of the eccentric motion element 10 considerably and the eccentricity of the cam 3 can be kept relatively small. The eccentric motion element 10 abuts on the pistons 6 with plane surfaces and the relative motion of the eccentric motion element 10 with respect to the pistons 6 is rather slow, which ensures less friction and noise. The timing of suction of working oil from the inner oil chamber 4 to the outer oil chamber 5 can be arbitrarily determined by varying the size and configuration of the suction orifice 13 of the piston 6 and/or the groove 14 of the eccentric motion element 10. Accordingly, the radial piston pump becomes adjustable for easy control of the operational characteristics. The valve device for control of the suction is constituted by both the piston 6 and the eccentric motion element 10 so that the one-way valve 9 can act on a single cylinder 1A. This allows the radial piston pump to be simple in arrangement and compact in size.

Figure 5:
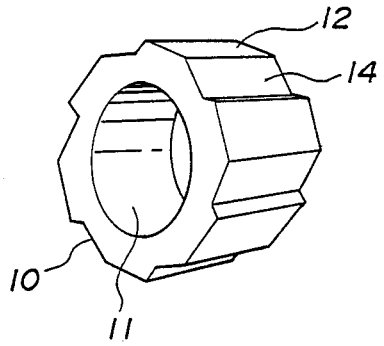
FIG. 5 is a perspective view of a modified version of the eccentric motion element.
Figure 6:
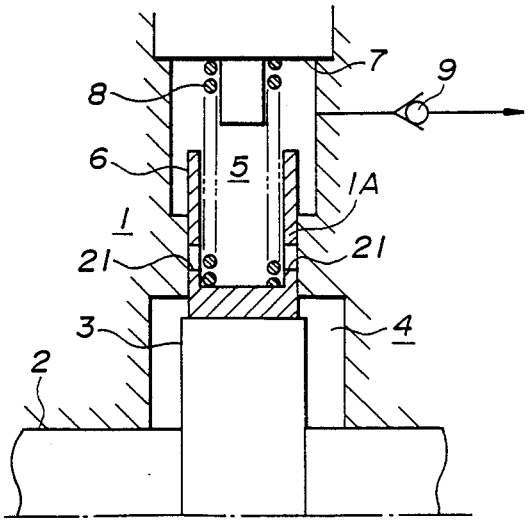
FIG. 6 is a cross sectional side view showing the schematic arrangement of a prior art pump.
Figure 7:
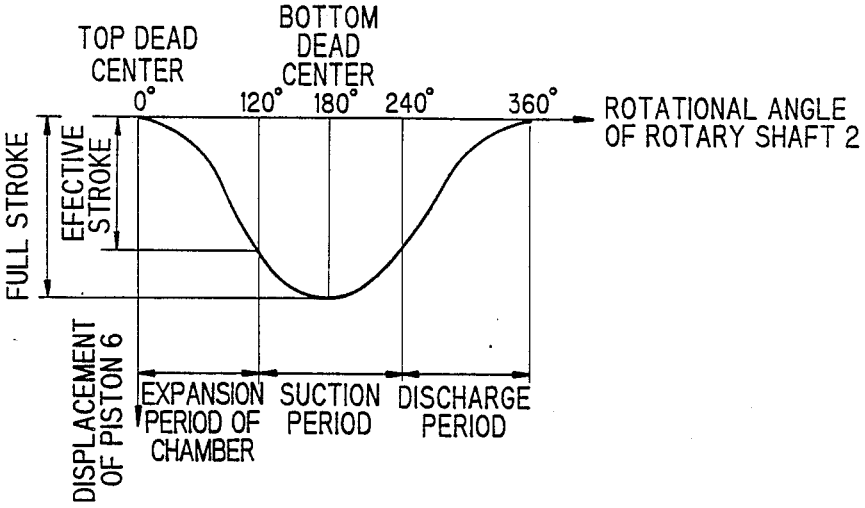
FIG. 7 is a timing chart showing the timing of suction of the prior art pump with respect to the relation between rotational angle of the rotary shaft and stroke of the piston.
Figure 8:
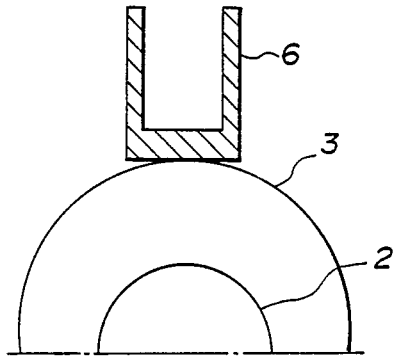
FIG. 8 is a front view showing the contact relation between the eccentric cam and the piston of the prior art pump.

Another configuration of the eccentric motion element 10 shown in FIG. 5, is so arranged that is open to the inner oil chamber 4 on both sides thereof. The groove 14 of this eccentric motion element is made of equal cross sections extending axially from one side to the other. The eccentric motion element 10 of this configuration permits the grooves 14 to be machined in a much easy way although its periphery 12 has a smaller extension for contact with the piston 6.

What is claimed is:

1. A hydraulic radial piston pump comprising a pump casing having an inner oil chamber receiving working oil and a plurality of radially disposed cylinders having inner radial ends open to said inner oil chamber, said cylinders each having an axis, pistons reciprocable in said cylinders, said pistons being generally hollow having an open outer radial end and an inner radial end having an inner end wall, said inner end wall having an external flat surface perpendicular to said axis of said cylinder, said cylinders having an outer radial end, a cap mounted on said casing for closing off said outer radial end of each of said cylinders, a coil spring between said cap and said inner end wall of said piston biasing said pistons radially inwardly, each of said inner end walls of said piston having an orifice having a center coincident with said axis of said cylinder, a rotary shaft rotatably mounted on said casing, an eccentric member mounted on said shaft, said eccentric member having a plurality of flat sides with one flat side being generally perpendicular to the axis of each cylinder, one of said flat sides of said eccentric member abutting one of said external flat surfaces of each end wall of said pistons, said abutting of said flat sides of said eccentric member against said external flat surfaces of said end wall of said piston preventing rotation of said eccentric member as said shaft rotates, said spring biasing said external flat surfaces of said end wall of said pistons against said flat sides of said eccentric member, said eccentric member being eccentrically mounted on said shaft such that as said shaft rotates, said eccentric member shifts its position relative to the axis of said shaft without rotating to thereby effect reciprocation of said pistons within said cylinders, grooves in each of said flat sides of said eccentric member, said grooves being disposed on said flat sides of said eccentric member such as to provide communication between said orifice and said oil chamber when said piston moves radially inwardly during a suction stroke and to preclude communication between said orifice and said oil chamber when said piston moves radially outwardly during a compression stroke, said hollow pistons having an interior chamber defining part of an outer oil chamber, said outer oil chamber extending between said inner end wall of said piston and said cap which closes if said outer radial end of said cylinder, said spring being disposed within said outer oil chamber, each of said cylinders having a radial inner portion and a radial outer portion, said radial inner portion having a diameter corresponding substantially to the outer diameter of said piston, said radial outer portion having a diameter greater than the diameter of said radial inner portion to thereby define an annular chamber portion in said casing disposed radially ouwardly of said piston, said annular chamber portion having an outer cylindrical wall, a delivery passage in said casing opening up into said outer cylindrical wall of said annular chamber portion for delivering oil from said outer oil chamber, and one-way valves in said casing and in said delivery passage to provide for one-way flow of oil from said outer oil chamber to said delivery passage for discharge.

2. A hydraulic radial piston pump according to claim 1, wherein said casing has six cylinders and said eccentric member has six of said flat sides.

3. A hydraulic radial piston pump according to claim 1, wherein said outer cylindrical wall of said annular chamber portion has an opening leading to said delivery passage, said delivery passage having a delivery passage portion juxtaposed to said opening which extends perpendicular to said axis of said cylinder.

4. A hydraulic radial piston pump according to claim 1, wherein said eccentric member has two spaced transverse end walls perpendicular to the axis of rotation of said rotatable shaft, said eccentric member having an axial length extending from one transverse end wall to the other transverse end wall, said grooves extending the axial length of said eccentric member from one transverse end wall to the other transverse end wall.

* * * * *